US005079115A

United States Patent [19]

Takashima et al.

[11] Patent Number: 5,079,115

[45] Date of Patent: Jan. 7, 1992

[54] COLOR ELECTROPHOTOGRAPHIC METHOD AND APPARATUS

[75] Inventors: Yuji Takashima, Nishinomiya; Hajime Yamamoto, Osaka, both of Japan

[73] Assignee: Matsushita Electric Industrial Co., Ltd., Japan

[21] Appl. No.: 372,389

[22] PCT Filed: Oct. 28, 1988

[86] PCT No.: PCT/JP88/01104

§ 371 Date: Jun. 12, 1989

§ 102(e) Date: Jun. 12, 1989

[51] Int. Cl.[5] ..... G03G 13/01

[52] U.S. Cl. ..... 430/45; 355/263; 118/645

[58] Field of Search ..... 430/45

[56] References Cited

U.S. PATENT DOCUMENTS 4,756,985 7/1988 Haneda et al. ..... 430/45 X

FOREIGN PATENT DOCUMENTS 57-130043 8/1982 Japan .
58-202458 11/1983 Japan .
59-161983 9/1984 Japan .
63-144360 6/1988 Japan .
63-188571 8/1988 Japan .

*Primary Examiner*—David Welsh
*Attorney, Agent, or Firm*—Lowe, Price, LeBlanc & Becker

[57] ABSTRACT

According to a conventional one-time transfer type color electrophotographic method, since used is a color toner by which the maximum image density can first be obtained by overlapping of 4 to 6 layers, there are problems that the color tone of a mixed color image formed by piling up color-different toner images one after another varies and color irregularity occurs. On the other hand, according to the present invention, by using a color toner whereby the maximum image density of the toner can be attained with one toner layer, the aforementioned problems can be eliminated, and the reproduction of the mixed color image can be achieved by the one-transfer system. In addition, according to the present invention, it is possible to reproduce a clear full-color image with gradation.

6 Claims, 1 Drawing Sheet

COLOR ELECTROPHOTOGRAPHIC METHOD AND APPARATUS

TECHNICAL FIELD

The present invention relates to a color electrophotographic method and apparatus which performs an image-exposure on a toner image held on a photoconductor to form a toner image on the first-mentioned toner image with a toner different in color from the first-mentioned toner image.

TECHNICAL BACKGROUND

Conventionally known is a three-times transfer type color electrophotographic method in which, using powder toners with three colors, i.e., yellow (Y), Magenta (M) and cyan (C), overlaps toner images with three colors on a transfer sheet by, for each toner, repeating three times an electrophotographic process including charge, color-separation exposure, development, transfer and cleaning.

In this system, it should be required to transfer on a transfer sheet each of three-color toner images to be successively formed on the photoconductor without occurrence of position slippage. This provides a problem that a transfer drum in addition to the photoconductor is required to cause the apparatus to increase in size and become complex.

Accordingly, in order to remove the aforementioned problem are proposed various one-time transfer type color electrophotographic methods which do not require the transfer drum. That is, this is a system in which a toner-image forming cycle including electrification, exposure and development is repeated several times so as to form on the photoconductor a plurality of toner images which are different in color from each other before collectively transferring them to a transfer sheet. One well known example of such systems is disclosed in U.S. Pat. No. 4,599,286.

For such a one-time transfer system, one important point for determining the color image quality is to perform electrification, exposure and development on the photoconductor having a toner image so as to faithfully form a toner image on the first-mentioned toner image with respect to an optical image, the toner image to be formed being different in color from the first-mentioned toner image. Therefore, the optical characteristic of a toner layer making up the toner image results in being extremely important.

However, since performance required for the toner layer is not known conventionally, it is difficult to obtain a clear full-color image. Particularly, there are problems that the color tone of a mixed color image formed by overlapping of a color-different toner image varies and nonuniformity occurs in color, thereby causing extreme deterioration of the image quality of a full-color image.

A description will be given hereinbelow in terms of the problems. In the development process of the conventional one-time transfer system, as disclosed in the above-mentioned U.S. Pat. No. 4,599,286, the two-component magnetic brush developing method is general where a two-component developer, being a mixture of a carrier magnetic powder and a toner, is used and the development is effected with the developer being spiked by a magneto. A description will be made with reference to this two-component magnetic brush developing method in terms of the case of forming a mixed color image in which a first toner image is overlapped with a second toner image whose toner layer thickness is constant.

When a photoconductor holding the first toner image is charged and then the first toner image is exposed from the upper side with a second optical image with constant quantity of light and developed with a second toner, the adhesion amount of the second toner varies in accordance with the toner layer thickness of the first toner image. That is, in order to obtain a desirable mixed color image, it is essentially required that the adhesion amount of the second toner is constant irrespective of the toner layer thickness of the first toner image. However, the second toner is adhered to be relatively thick at a portion that the toner layer thickness of the first toner image is small. On the contrary, the second toner is adhered to be relatively thin at a portion that the toner layer thickness of the first toner image is great.

According to analysis of this cause, it has been found that the adhesion amount of the second toner is decreased exponentially in accordance with increase in the toner layer thickness of the first toner image, more specifically the number of the laminated toner layers. This is due to the fact that the scattering quantity of light passing through the toner layer increases as the number of toner layers of the first toner image and hence the quantity of light passing through the toner layer and reaching the photoconductor exponentially decreases to cause the surface potential of the photoconductor to vary. For example, in the case of a yellow toner with an average particle diameter of 10 $\mu$m, when the quantity of light transmitting one layer (toner covering rate: 50%) is taken as 100%, two layers result in about 20% and three layers result in several %. Furthermore, when the photoconductor is charged by means of a corona charger in order to form a second toner image, the charged amounts of the first toner and the photoconductor are distributed in inverse proportion to the electrostatic capacities of the first toner layer and the photosensitive layer. Therefore, in cases where the toner layer thickness of the first toner image is nonuniform, it is understood that the charged amount of the photoconductor itself becomes nonuniform.

Accordingly, in order to attain a clear mixed color image with the one-time transfer system, it is required to use a toner which can provide a high density irrespective of a small number of layers and further employ a developing method which is capable of performing the development so that the toner layer thickness is small and uniform.

However, conventional color toners are arranged so that the maximum density can be first obtained with overlapping of four to six layers. In addition, in the two-component magnetic brush developing method, the adhesion amount of a toner to be developed varies delicately due to variation of the mixing ratio of the toner and carrier and others even if the surface potential of the photoconductor is constant, and therefore, it is extremely difficult to develop the toner layer to be thin and uniform. Moreover, with respect to a high density image in which the toner adhesion amount becomes great, the toner layer thickness varies so as not to become constant.

From the above-described reasons, when reproducing a high-density mixed color image with the conventional one-time transfer system, the one-color toner layer thickness becomes great and the toner layer thickness greatly varies, and therefore, the color tone may vary and color nonuniformity occurs.

DISCLOSURE OF THE INVENTION

The present invention eliminates the problems inherent to the conventional systems and provides a color electrophotographic method and apparatus which is capable of attaining to a clear mixed color image with high density and stable color tone.

The present invention is characterized in that in a color electrophotographic method including the steps of performing an image exposure through a toner image with respect to an electrostatic image holding device carrying the toner image and of performing development on the above-mentioned toner image with a toner different in color from the above-mentioned toner image, a clear color image with high density and color stability can be obtained by using a transparent color toner which substantially provides the maximum density of the toner, determined in the apparatus, by one toner layer.

According to the present invention, the maximum density of the toner can be obtained with one toner layer, where it is possible to arrange one-color toner image with one toner layer. Therefore, since it is possible to thin the toner layer thickness in forming a high-density mixed color, the variation of quantity due to the variation of the toner layer thickness can be reduced in exposure, thereby attaining to a clear color image with less color unevenness. In addition, with respect to the one-color toner image, even if the toner is partially overlapped so as to form two layers, since the saturation density is achieved with one toner layer, it is possible to attain a high-density mixed color image whose color tone is stable.

MOST PREFERRED EMBODIMENT OF THE PRESENT INVENTION

Figure 1:
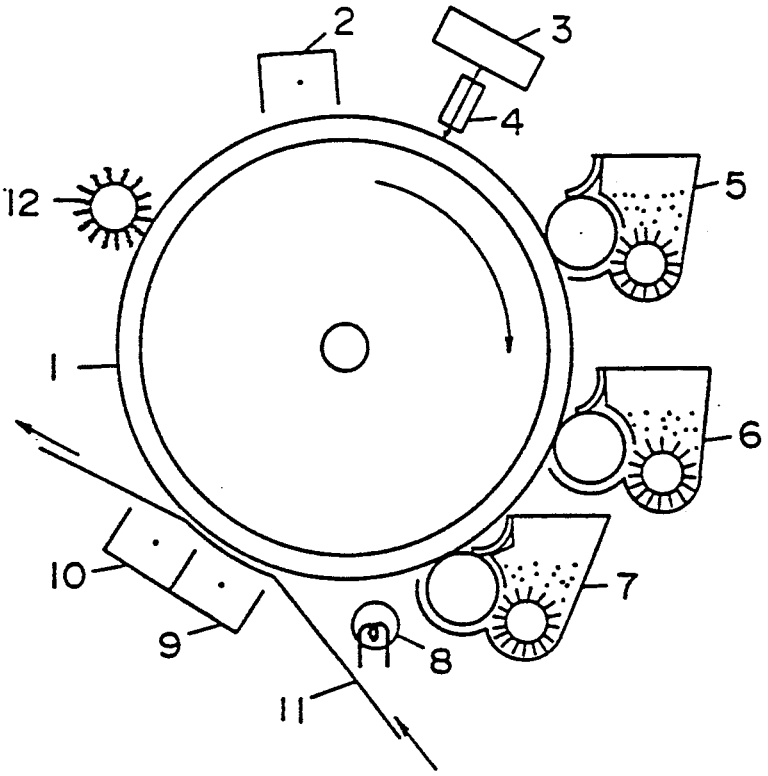
FIG. 1 is a schematically cross-sectional view showing an arrangement of an apparatus made by embodying a color electrophotographic method according to an embodiment of the present invention.

The present invention will be described hereinbelow with reference to embodiments. As a color toner to be used in the present invention is used any one of transparent color toners for electrophotography which are adjusted so as to obtain the predetermined maximum image density with one toner layer. Attaining a desirable image density with one toner layer can be easily achieved by adjusting the amount of a coloring material included in the toner component. In the toner features, it is preferable to have an excellent transparency and to be a non-magnetic toner whose resistivity is above $10^{12}\Omega$·cm. Further, the average particle diameter is preferable to be below 15 μm.

For reproduction of the full-color image used three kinds of toners, i.e., yellow, magenta and cyan. In this instance, the color density of each of the color toners is preferable to be above 0.8. More preferably, it is over 0.8 for yellow, above 1.1 for magenta, and above 1.2 for cyan. For example, in order to obtain a color density of above 0.8 with one toner with particle diameter of 10 μm, in the case that the coloring material is a pigment, it is 3 to 8 weight % with respect to the toner component, and in the case of a dye, it is 1 to 6 weight % with respect thereto.

In the one-time transfer color electrophotographic method, in order to form a plurality of toner images on the photoconductor, as a developing means to be employed is preferable a developing method in which the developer does not come directly into contact with the toner image on the photoconductor. Here, from the viewpoint of performing the development so that the toner layer thickness is thin and stable, an electric field flying developing method which is arranged to fly the toner with an electric field is suitable. Particularly, a direct-current electric field flying developing method is suitable because the development fogging due to the reverse polarity is little.

The electric field flying developing method using a one-component developer is a method in which a toner-holding device holding a toner thin layer is disposed to face the photoconductor so that the thin layer is in no contact relation therewith and a voltage is applied to between the toner-holding device and the photoconductor so as to fly the toner. Therefore, it is preferable that the toner has an excellent flowability and the charge amount is stable in a range of 1 to 15 μC/g. Providing such characteristics to the toner is achieved by keeping on the surface or inside the toner component an inorganic material such as silica, barium sulfate, barium titanate, aluminum oxide, titanium oxide and tin oxide. Particularly, with respect to the toner whose surface has microscopic powder of silica and tin oxide, the charge amount is stable so as to attain uniform image density. The addition amount of the silica and the tine oxide is suitable to be below 1 weight % with respect to the toner component.

Figure 2:
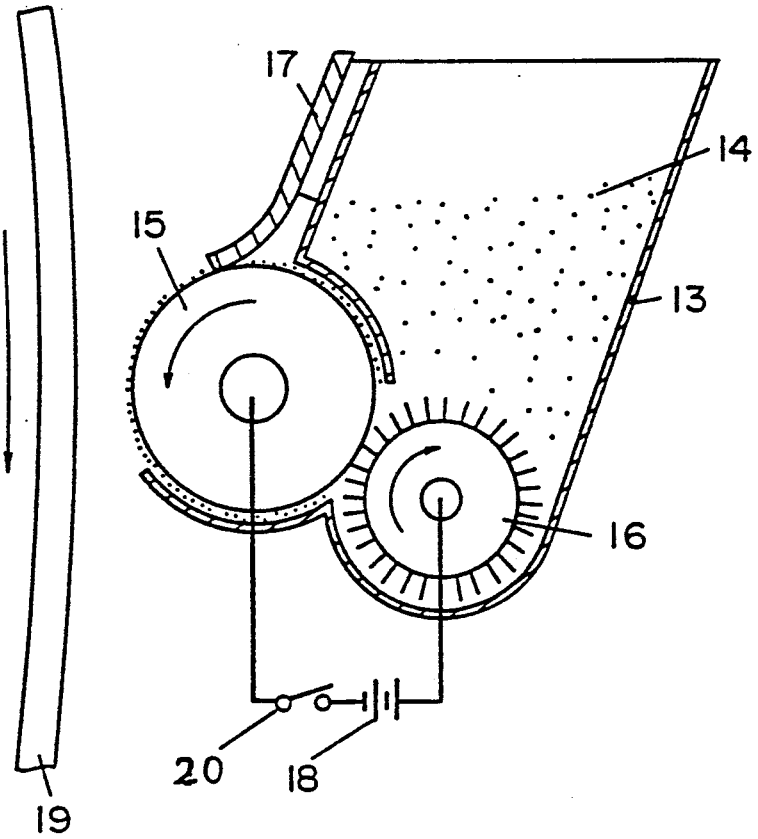
FIG. 2 is a schematically cross-sectional view showing an arrangement of a developing device of the same apparatus.

One example of arrangements of a developing device based on the direct-current electric field flying method is illustrated in FIG. 2. In FIG. 2, numeral 13 represents a toner container, 14 designates a non-magnetic toner, 15 depicts a toner holding device constructed by a cylindrical metal such as aluminum and stainless, 16 denotes a conductive fur brush roller arranged so that a conductive roller carries a resin fiber including carbon, for example, or a metal fiber, 17 represents a rubber blade, 18 designates a direct-current electric power, and 20 is a switch. The toner holding device 15 is disposed to keep a predetermined distance with respect to the photoconductor 19 so that the toner does not come into contact with the photoconductor 19. The space between the toner holding device 15 and the photoconductor 19 is preferable to be below 300 μm, more preferably 50 to 150 μm.

When rotating the toner holding device 15 and the fur brush roller 16 in the direction indicated by an arrow, the toner 14 is frictionally charged so as to be electrostatically adhered to the toner holding device 15. Further, it is rolled by the rubber blade 17 so as to form a toner thin layer, whose thickness is 20 to 50 μm, on the toner holding device 15. Here, it is appropriate that the fur brush roller 16 is electrically risen or grounded. Further, for control of the image density, a direct-current voltage or an alternating current voltage is applied between the fur brush roller 16 and the toner holding device 15 so as to electrically control the toner amount to be supplied to the toner holding device 15.

Subsequently, a description will be given in terms of a technique preferable to reproduce a full-color image with gradation in the one-time transfer color electrophotographic method according to the present invention.

For the reproduction of the gradation image either well known density gradation method or area gradation method is usable. Of these methods, suitable is the area gradation method which divides the image into a plurality of small picture elements and indicates in dummy the gradation by varying the area with the density of the picture element being constant. This is due to that fact that the present invention is particularly excellent in the case of reproducing a solid image with uniform density and high density.

For obtaining a gradation image by means of the area gradation method, as a light source is used an optical writing device such as a laser optical system, a photodiode array and a crystal liquid switching element and used is a well known method which performs the scanning exposure in correspondence with an image signal area-modulated.

EMBODIMENT 1

With a manufacturing method to be disclosed hereinbelow, three kinds of toners, i.e., yellow toner, magenta toner and cyan toner can be obtained.

(1) Yellow Toner

After kneading the following components for about two hours at a temperature of 150° C., a yellow toner base material of 5 to 15 μm (average particle diameter: 10 μm) can be obtained by cooling, smashing and classification.

coloring material: C.I. pigment yellow 12—50 g
binding agent: styrene acryl resin—930 g
charge control agent: aminated styrene resin—20 g Secondary, the following mixtures are agitated by means of a Henschel mixer to obtain a yellow toner.

Y toner base material—500 g
silica fine powder—20 g
tin oxide fine powder—15 g

(2) Magenta Toner

After kneading the following components for about two hours at a temperature of 150° C., a magenta toner base material of 5 to 15 μm (average particle diameter: 10 μm) can be obtained by cooling, smashing and classification.

coloring material: C.I. pigment red 5—60 g
binding agent: styrene acryl resin—910 g
charge control agent: aminated styrene resin—30 g Secondary, the following mixtures are agitated by means of a Henschel mixer to obtain a magenta toner.

M toner base material—500 g
silica fine powder—20 g
tin oxide fine powder—15 g

(3) Cyan Toner

After kneading the following components for about two hours at a temperature of 150° C., a cyan toner base material of 5 to 15 μm (average particle diameter:10 μm) can be obtained by cooling, smashing and classification.

coloring material: C.I. pigment yellow 15—50 g
binding agent: styrene acryl resin—930 g
charge control agent: aminated styrene resin—20 g Secondary, the following mixtures are agitated by means of a Henschel mixer to obtain a cyan toner.

C toner base material—500 g
silica fine powder—20 g
tin oxide fine powder—15 g

A color image has been formed using the above-mentioned three kinds of toners by means of an apparatus illustrated in FIG. 1.

In FIG. 1, numeral 1 represents a photoconductor (the layer thickness of the photosensitive layer: 60 μm, electrostatic capacity: 92 pF/cm$^2$) formed by deposition of selenium-tellurium on an aluminum drum, 2 designates a scorotron charger (corona voltage: +7 kV, grid voltage: +850 V), 3 denotes a light emitting diode array (output: 7 μW, emitted light wavelength: 670 nm, dot density: 240 dot/inch), 4 is a focusing lens array, 5, 6 and 7 represent developing devices in which yellow, magenta and cyan toners are independently encased, 8 designates an electricity-removing device such as an erase lamp and an AC corona discharger, 9 depicts a corona charger for transfer, 10 is an AC eraser for paper separation, 11 depicts a plain paper sheet and 12 is a cleaning brush.

Each of the developing devices has the same arrangement as in the description of FIG. 2. As the toner holding device 15 is used an aluminum tube whose surface is roughened, and as the fur brush roller 16 is used a device constructed by planting a rayon fiber including a carbon, whose resistivity is $10^6$ Ω, on an aluminum tube. The charge amount of each toner holding device when the developing device is driven has been found to be 2 to 5 μC/g. Further, the space between the photoconductor and the toner holding device is determined to be 150 μm.

A description will be made hereinbelow in terms of an image-forming method. With the photoconductor 1 being rotated at a speed of 100 mm/s in the direction indicated by an arrow, the photoconductor 1 is charged up to +800 V by means of the scorotron charger 2. Subsequently, the yellow image signal is scanning-exposed by means of the light emitting diode array 3, thereby resulting in a non-imaged line portion of +800 V and an image portion of +40 V so as to form a negative electrostatic latent image. After the exposure, the photoconductor 1 is passed though the three developing devices so as to perform an inversion development with the Y toner. The layer thickness of the Y toner developed is about 12 μm. In this instance, the set conditions of the respective developing devices are as follows.

(1) Yellow Developing Device 5 application voltage to the toner holding device: +750 V
application voltage to the fur brush: +850 V
toner layer thickness on toner holding device: about 40 μm

(2) Magenta and Cyan Developing Devices 6,7 application voltage to the toner holding device: grounded
application voltage to the fur brush: grounded
toner layer thickness on toner holding device: about 40 μm After development, the photoconductor 1 holding the yellow toner image is illuminated by means of the erase lamp 8, and after light discharge for the electrostatic latent image, it is again charged by the scorotron charger 2. The surface potential of the photoconductor 1 is +800 V irrespective of the presence or absence of the toner.

Subsequently, the magenta image signal is scanning-exposed by means of the light emitting diode array 3 so as to form a negative electrostatic latent image. The surface potential of the image portion at a portion that the yellow toner is absent is +40 V, and the surface potential of the image region at the yellow-toner attaching portion is +160 V. Following the exposure, the photoconductor 1 is passed through the three developing devices 12, 13 and 14 under the following conditions to perform the inversion development with the magenta toner. The layer thickness of the toner image obtained is about 12 μm at the portion that only the magenta toner is present and is about 21 μm at the portion that the yellow toner and the magenta toner are overlapped with each other. The magenta toner is not adhered at all at the non-image region in the Y toner attachment portion.

(1) Yellow and Cyan Developing Devices 5, 7 application voltage to the toner holding device: +750 V
application voltage to the fur brush: +550 V
toner layer thickness on toner holding device: 0

(2) Magenta Developing Device 6 application voltage to the toner holding device: +750 V
application voltage to the fur brush: +850 V
toner layer thickness on toner holding device: about 40 μm After again electricity-removing the photoconductor 1, it is charged by the scorotron charger 2. the surface potential of the photoconductor is +800 V regardless of the presence or absence of the toner.

Secondly, the cyan image signal is scanning-exposed by means of the light emitting diode array 3. The surface potential of the image portion at a portion that the toner is absent is +40 V, the surface potential is +160 V at the portion that only the yellow toner and the magenta toner are adhered, and the surface potential is +220 V at the portion that the yellow toner and the magenta toner are overlapped with each other. The photoconductor 1 is passed through the three developing devices 5, 6 and 7 under the following conditions to perform the inversion development with the cyan toner. The cyan toner is not adhered at all at the non-image region in the yellow and magenta toner attachment portion.

(1) Yellow and Magenta Developing Devices 5, 6 application voltage to the toner holding device: +750 V
application voltage to the fur brush: +550 V
toner layer thickness on toner holding device: 0

(2) Cyan Developing Device 6 application voltage to the toner holding device: +750 V
application voltage to the fur brush: +850 V
toner layer thickness on toner holding device: about 40 μm Further, after illuminating the entire surface of the photoconductor 1 by means of the erase lamp 8, the toner image on the photoconductor 1 is transferred to a plain paper sheet 11 by means of the corona charger 9 (corona voltage: −5.5 kV) and then the plain paper sheet 11 is electricity-removed by the AC eraser 10 and separated from the photoconductor 1. The toner image transferred to the plain paper sheet 11 is heated by a heat fixing device (not shown) so as to attain a color print. Following the transfer, the remaining toner on the photoconductor 1 is removed by the cleaning brush 12 so that the photoconductor 1 is again placed in condition for allowing the next image formation. As a result, obtained is a clear color print in which the respective reproduced color densities are as follows: yellow:1.1, magenta:1.4, cyan:1.5, red: 1.4, green:1.4, blue-violet:1.5, and black:1.4 resulting from three-color composition.

EMBODIMENT 2

A description will be described hereinbelow in terms of a method of obtaining a full-color image by the area gradation method due to the well known Dither matrix technique using the apparatus described in the embodiment 1. For the respective image signals of yellow, magenta and cyan, the Dither process is performed so that one picture element takes 4 dot×4 dot, and with the method similar to that of the embodiment 1, the color image is reproduced, whereby it is possible to obtain a full-color image so that each of yellow, magenta and cyan has 16 gradations.

INDUSTRIAL APPLICATION POSSIBILITY

As described above, according to the present invention, since it is possible to obtain a clear mixed color image with high density and stable color tone, it is suitable for a color hard copying apparatus such as color copying machine, color light printer and color facsimile.

What is claimed is:

1. A color electrophotographic method of using at least two different toners and performing a charge, exposure and development so as to superimpose different-color toner images on one electrophotographic photoconductor, said method comprising the steps of:

(a) uniformly charging said electrophotographic photoconductor by means of a corona charger;

(b) illuminating said photoconductor with a first light-image so as to form a first electrostatic latent image on said photoconductor;

(c) applying a direct-current voltage between said photoconductor and a developer-holding device which carries a thin layer of a first one-component developer mainly comprising a first colored powder toner and which is disposed to be in confronting relation to said photoconductor with a predetermined separation being maintained therebetween so as not to cause said developer to directly come into contact with said photoconductor whereby said developer on said holding device moves toward said photoconductor by means of the action of an electric field so that said first electrostatic latent image formed on said photoconductor is developed with said first one-component developer having the colored first powder toner to form a first toner image by said first powder toner on said photoconductor;

(d) again uniformly charging said photoconductor holding said first toner image from an upper side of said first toner image by means of a corona charger;

(e) illuminating said photoconductor holding said first toner image with a second light-image so as to form a second electrostatic latent image thereon; and (f) developing said second electrostatic latent image using a second one-component developer comprising a second colored powder toner in accordance with a developing method as described in step (c) so as to superimpose a second toner image of said second colored powder toner on said photoconductor holding said first toner image, wherein each of said first and second one-component developers are non-magnetic materials mainly composed of a light-transmitting non-magnetic toner mainly comprising a resin binding agent, at least one of a dye and colored pigment, and a charge control agent and having an average particle diameter below 15 μm, and in steps (c) and (f) said development is performed under the conditions that the toner charge amount of said developer thin-layered on said developer-holding device is 1 to 15 μC/g, the separation between said developer-holding device and said photoconductor is below 300 μm, and the value of the direct-current to be applied to between said developer-holding device and said photoconductor is determined so that the maximum thickness of the toner to be electrostatically adhered onto said photoconductor though the development is below twice the average particle diameter of the toner.

2. A color electrophotographic method as claimed in claim 1, wherein to each of said first and second one-component developers there is added at least one inorganic fine powder selected from a group of silica, barium sulfate, barium titanate, titanium oxide and tin oxide.

3. A color electrophotographic method as claimed in claim 2, wherein to each of said first and second one-component developers there are added the silica and tin oxide each of whose amount is below 1 weight % with respect to the toner.

4. A color electrophotographic apparatus comprising:

an endless electrophotographic photoconductor arranged to be movable in one direction;

a charger for applying a charge to said photoconductor;

a light-writing light source for performing image-exposure in correspondence with an image signal;

a plurality of developing devices independently having one-component developers mainly comprising yellow, magenta and cyan powder toners, respectively, each of said developing devices being equipped with developer-holding means holding thereon a thin layer of the corresponding powder toner which is disposed in confronting relation to said photoconductor with a predetermined separation maintained therebetween so as not to cause the thin-layer toner to come into contact with said photoconductor, and further equipped with voltage-applying means for applying a direct-current voltage between said developer-holding means and said photoconductor so as to cause toner to fly toward said photoconductor by means of an electric field to form a toner image on said photoconductor; and a transferring device for electrostatically transferring the formed toner image to an image-receiving sheet, said apparatus moving said photoconductor to uniformly charge said photoconductor by said charger, and exposing said photoconductor with light emitted from said light source in accordance with the selected one of said image signals for the yellow, magenta and cyan toners so as to form an electrostatic latent image on said photoconductor, and operating the corresponding developing device to develope the formed electrostatic latent image so as to form the toner image on said photoconductor, said apparatus further performing the similar processes for forming the other color tone images one upon another on said photoconductor to produce a superimposed color toner image, and performing batch transfer of the superimposed color toner image onto the image-receiving sheet by means of said transferring device, wherein said one-component developer for each of the yellow, magenta and cyan is mainly composed of a light-transmitting non-magnetic toner mainly comprising a resin binding agent, at least one of a dye and colored pigment, and a charge control agent and having an average particle diameter below, 15 μm, and said development is performed under the conditions that the toner charge amount of said developer thin-layered on said developer-holding device is 1 to 15 μC/g, the separation between said developer-holding device and said photoconductor is below 300 μm, and the value of the direct-current to be applied to between said developer-holding device and said photoconductor is determined so that the maximum thickness of the toner to be electrostatically adhered onto said photoconductor through the development is below twice the average particle diameter of the toner.

5. A color electrophotographic apparatus as claimed in claim 4, wherein each of said developing devices includes said developer-holding means having an endless configuration movable so as to carry and provide developer up to and at the vicinity of said photoconductor, a developer vessel for encasing the developer, developer-supplying means for supplying the developer from said developer vessel up to a surface of said developer-holding means, and layer-thickness limiting means for forming a thin layer of the developer held on the surface so that the thickness of the formed thin layer becomes constant.

6. A color electrophotographic apparatus as claimed in claim 4, wherein said image signal is a signal area-modulated.

* * * * *